US005393240A

United States Patent [19]

Makal et al.

[11] Patent Number: 5,393,240

[45] Date of Patent: Feb. 28, 1995

[54] SEPARABLE LOADBREAK CONNECTOR

[75] Inventors: John M. Makal, Menomonee Falls, Wis.; Wayne W. Lien, Laurel, Miss.; William J. McNulty, River Forest, Ill.

[73] Assignee: Cooper Industries, Inc., Houston, Tex.

[21] Appl. No.: 69,012

[22] Filed: May 28, 1993

[51] Int. Cl.[6] ..... H01R 13/53

[52] U.S. Cl. ..... 439/187; 439/921

[58] Field of Search ..... 439/181–187, 439/921

[56] References Cited

U.S. PATENT DOCUMENTS 3,930,709 1/1976 Stanger et al. .
3,957,332 5/1976 Lambert, III .
4,186,985 2/1980 Stepniak et al. .
4,773,872 9/1988 Borgstrom et al. ..... 439/185
4,822,291 4/1989 Cunningham ..... 439/921 X
4,863,392 9/1989 Borgstrom et al. ..... 439/185
5,213,517 5/1993 Kerek et al. ..... 439/187
5,222,899 6/1993 Hulderman ..... 439/187 X

*Primary Examiner*—Khiem Nguyen
*Attorney, Agent, or Firm*—Conley, Rose & Tayon

[57] ABSTRACT

A load separable connection is provided, including a loadbreak elbow having a contact probe, and a bushing into which the contact probe is received in a tulip contact therein. An ablative insert, including a projecting lip extending over the outer circumference of the tulip contact at the end thereof, is provided within bushing. The insert helps extinguish arcs created during live connection of the elbow over the bushing, and also helps physically block the access of the arc to the bushing components surrounding the tulip contact.

10 Claims, 7 Drawing Sheets

SEPARABLE LOADBREAK CONNECTOR

BACKGROUND OF THE INVENTION

The present invention relates generally to the field of power distribution equipment. More particularly, the invention relates to loadbreaking connectors for distribution equipment. Still more particularly, the invention relates to separable loadbreaking bushing and elbow connectors used to connect distribution conductors to transformers and other equipment.

Separable connectors are typically employed to interconnect sources of energy, such as electrical distribution network conductors, to localized distribution components, such as transformers. These connectors, for example, typically include a bushing insert, which is mounted in the bushing well of the transformer, and an elbow connector which is releasably connected to the bushing insert. In this application the bushing insert and bushing well combination are replaced with a one piece bushing. The bushing electrically connects to a transformer winding and the elbow is connected to a distribution conductor of the network circuit feeding the transformer. When the elbow is interconnected to the bushing, the transformer is thus interconnected into the distribution network and thereby energized. Likewise, if the elbow is removed, the transformer is disconnected from the distribution network and the transformer is de-energized.

To carry electric current through the separable connectors and into the transformer from the distribution conductor, each of the separable components include a conductive member which serves as the current carrying path. The conductive member in the elbow includes an elongated metallic rod which forms a probe connector. The conductive member in the bushing includes a female contact, which receives the probe as the elbow is pushed over the bushing to make a connection. The elbow is structured in a general L-shape such that the distribution conductor is received in one arm of the elbow and interconnected to the probe therein, and the probe is retained in and extends through the other arm of the elbow and disposed generally at a right angle to the conductor. The probe is protected by an insulative shroud which is circumferentially disposed about the probe such that there is an annular space between the probe and the inner surface of the shroud. When the elbow is interconnected to the bushing, a portion of the bushing is received within this annular space, and the probe is received within the female contact in the bushing.

The female contact is disposed inside the bushing within a contact tube. The female contact includes a cylindrical probe receiving portion into which the probe of the elbow is engaged when the elbow is placed onto the bushing. This receiving portion typically includes a tulip contact which is configured with a series of longitudinal slots through the end thereof. The material between the slots forms petals which are inwardly biased in a radial direction such that the receiving end of the contact, prior to the reception of the probe, has a diameter smaller than the diameter of the probe. The petals of the contact are actuable radially outward upon reception of the probe therein. The female contact is commonly referred to as a tulip contact, because the arrangement looks like the flower of a tulip plant. The elasticity of the tulip contact petals create an inward spring force to cause the contact to grip the probe. To permit the tulip contact to expand radially outward within the contact tube to receive the probe, a gap, or clearance annulus, is provided between the outer surface of the tulip contact and the inner diameter of the contact tube.

The distribution conductor, and thus the elbow probe, is commonly energized during normal use and may be energized both during installation of the elbow over the bushing and when the elbow is removed from the bushing. As a result, the materials used in the bushing and elbow must be capable of withstanding the extreme temperature and pressures that are generated during electrical arcing which can occur as the live, or energized, probe comes into contact with or is disengaged from the tulip contact.

During the interconnection of the elbow and bushing while the conductor is energized, as the probe comes into the proximity of the tulip contact, the voltage gradient between the live probe and the non-energized tulip contact increases. This gradient is measured in terms of voltage difference between the line voltage of the elbow and the potential of the bushing before the elbow is placed on the bushing, and the distance between high and low voltage components. The voltage between the elbow and bushing contacts may be as high as a phase to phase voltage of 36,600 volts, for example, and the line to ground maximum is 21.1 KV. When the probe is first inserted into the bushing, the differential voltage between the probe and tulip contact is supported by the dielectric strength of the air gap between the probe and the conducting components within the bushing. Arcing occurs when the dielectric strength of the weakest resistance path between the probe and tulip contact is less than the voltage differential between the probe and tulip contact. This path commonly includes both the air gap between the tulip contact and probe, as well as portions of the surface and structure of the elbow and bushing components. As the probe and tulip contact come closer together, the air gap component of the weakest resistance path decreases, thereby increasing the likelihood of an arc between the probe and contact along the weakest resistance path. The types and dimensions of the materials used in the elbow and bushing are selected to ensure that an arc-over condition should not prematurely occur along the surface of the elbow or bushing. This is accomplished by selecting internal components having a high dielectric resistance. This, combined with the dielectric resistance of the air gap between the probe and tulip contact as the elbow is slipped over the bushing, tends to prevent the incidence of arcing until the probe is within the contact tube containing the tulip contact. However, once the probe is in the immediate vicinity of the tulip contact, the dielectric strength of the air gap and/or adjacent component structures and surfaces may be exceeded, and an arc will then form between the probe and tulip contact. This arc between the probe and tulip contact will conduct currents which may be as high as the available fault current. However, in normal operation, the current is limited to 200 amps, per ANSI/IEEE standards. This arc will follow the path of least resistance between the probe and tulip contact, such path commonly including the interior surface of the contact tube and the outer surface of the probe follower. As the probe is moved further towards the tulip contact, the probe and tulip contact make physical contact and the arc will be extinguished as steady-state contact is achieved. In a similar manner, as the elbow is pulled off of the bushing while the components are in an energized state, an arc will again form between the probe and tulip contact as they separate.

The generation of arcs during the interconnection and disconnection of the elbow and bushing can lead to bushing and elbow degradation and failure. The energy and heat created during an arc can melt and burn the adjacent surface of the contact tube and carbonize the surface of the interior structure of the bushing and elbow causing them to lose their insulative qualities. More specifically, the occurrence of carbonization can create carbonized, and thus conductive, leakage paths along the surface of the bushing and elbow components, which will lead to further mechanical and electrical degradation of the bushing. Additionally, the gasses given off as the arc burns or melts the elbow and bushing components creates high pressures in the vicinity of the probe-tulip contact interface. Because this area is confined within the contact tube, with the probe blocking the opening of the tube, the gas pressure that is generated acts to impart an outward force on the probe which tends to repel the probe coming into contact with the tulip contact. This force, in turn, requires the installer to apply greater force to the back of the elbow to push the probe into contact with the tulip contact. If the installer inserts the elbow too slowly, or with insufficient force, the duration of the contact to probe arc can be greatly increased. The longer the arc is permitted to exist, the greater the chance of damage to the elbow and bushing components and the greater the gas pressure generated and the force needed to install the elbow on the bushing. Thus, both the elbow and bushing must be designed to minimize arcing.

To address the problems presented by arcing, the bushing typically includes one or more seals to seal out moisture and dirt which would otherwise enhance the surface conductivity of the bushing components and prematurely initiate arcing which will interfere with the probe-to-tulip contact engagement. The bushing may also include an ablative insert that is positioned in the location where the arc typically forms. This insert ablates, or vaporizes, when an arc contacts it. Upon ablation, the insert produces a gas which serves to help extinguish the arc. Additionally, many prior art devices employ additional features such as sliding, spring-loaded contacts, and magnetic inserts to help force the tulip contact and probe into engagement. Prior art devices which employ ablative inserts commonly include a tubular member molded from the ablative material which also forms a pilot for aligning the probe with the tulip contact. For example, FIG. 5 of U.S. Pat. No. 4,863,392, discloses an ablative tubular insert 230 which is disposed in the bushing 200 immediately in front of the tulip contact 224. The insert 230 terminates prior to engagement with the tulip contact 224, leaving a gap between these elements. Likewise, U.S. Pat. No. 3,957,332 discloses a quench tube 21 which terminates just prior to contacting the end of contact 17. This same basic configuration is disclosed in U.S. Pat. Nos. 4,186,985 and 4,773,872.

Despite the prior advancements in the art, the arcs created in present-day connectors can still induce the formation of carbonized paths and burning and melting of the elbow and bushing components. It has been found that some arcs will roll over the end of the tulip contact into the clearance annulus and destructively melt and vaporize the contact tube adjacent the clearance annulus. In conventional connectors, the arc can avoid engagement with the ablative insert for a not insubstantial distance and period of time, permitting the arc to substantially damage the bushing components.

SUMMARY OF THE INVENTION

The present invention is a loadbreak connector having an ablative insert within the bushing configured to project around the periphery of the tulip contact and extend into the space between the tulip contact and contact tube. The bushing includes an insulative sleeve having a tulip contact retained therein. The tulip contact and sleeve are mounted to a piston. The piston is equipped with a contact spring and is held in position within the bushing by a shear pin. The probe-engaging end of the tulip contact is oriented towards the open end of the sleeve. An ablative insert, having a central bore therethrough, is disposed between the tulip contact and the open end of the sleeve, and includes an annular lip portion extending between the outer surface of the tulip contact and the inner surface of the sleeve. The annular lip is sized and dimensioned to permit the petals or fingers of the tulip contact to expand upon insertion of the probe therein without interference from the lip, but to also substantially shield or block the surface of the sleeve and the clearance annulus from arc access. An annular seal portion is disposed between the ablative insert and the second end of the sleeve.

As the elbow is placed onto the bushing, the conducting probe therein passes through the seal and ablative insert until it is disposed adjacent the tulip contact. If the probe is energized, an arc may form between the probe and tulip contact. However, the presence of the annular lip on the ablative insert limits the accessibility of the arc to the area between the tulip contact and sleeve, thereby substantially eliminating are rollover into that area. Additionally, if the arc rolls over into this annular space, the lip of ablative material will ablate, and release an arc quenching gas to extinguish the arc. Thus, the present invention comprises a combination of features and advantages which enable it to substantially advance the art of loadbreak connectors by limiting the deleterious effects of the arcing which can occur during interconnection and disconnection of the elbow and the bushing. These and various other characteristics and advantages of the present invention will be readily apparent to those skilled in the art upon reading the following detailed description and referring to the accompanying drawings.

BRIEF DESCRIPTION OF THE DRAWINGS

For an introduction of the detailed description of the preferred embodiment of the invention, reference will now be made to the accompanying drawings, wherein.

DESCRIPTION OF THE PREFERRED EMBODIMENTS

Figure 1:
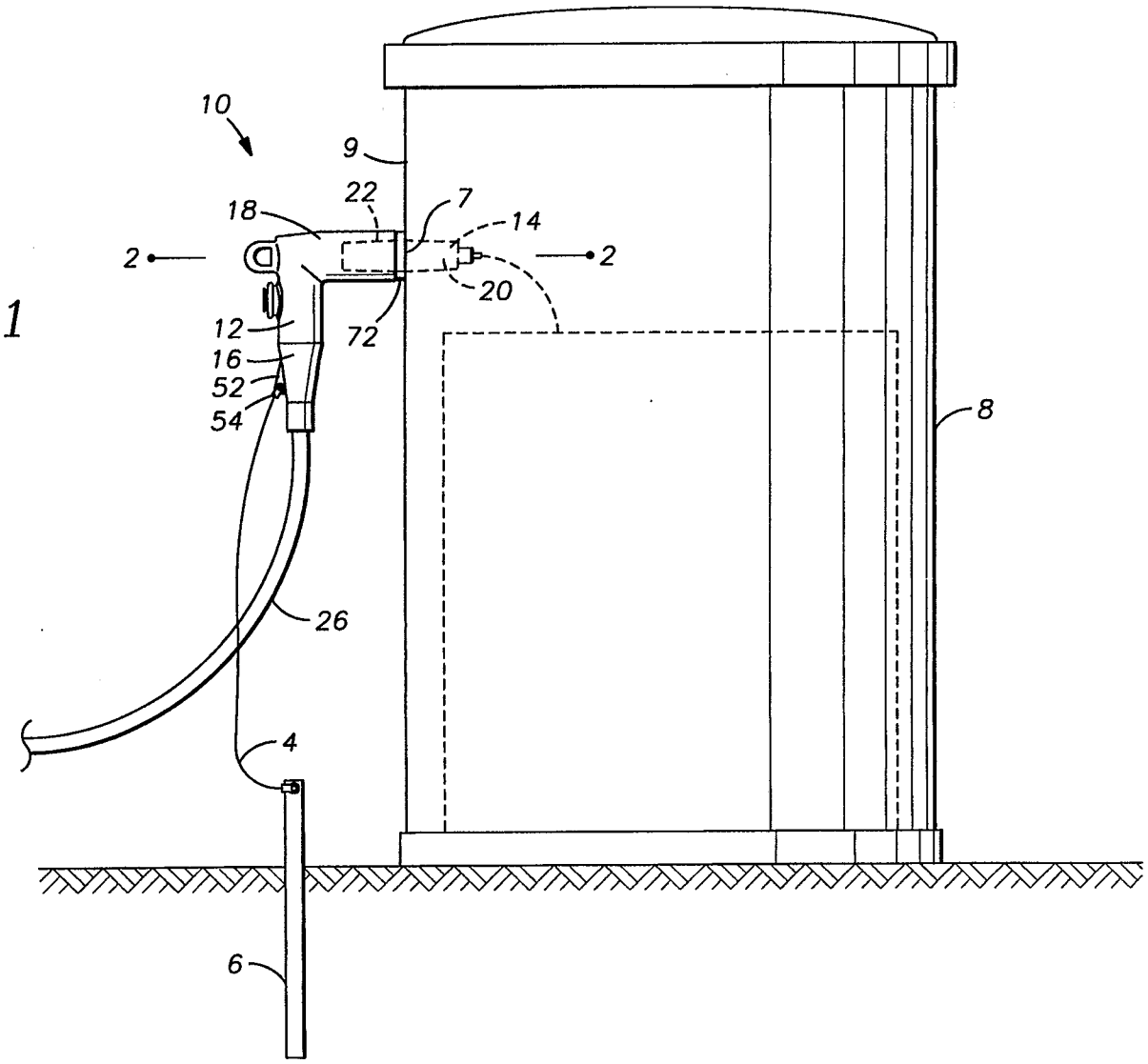
FIG. 1 is an elevational view, partly in cross-section, of the connector of the present invention installed on a transformer.

Referring first to FIG. 1, a high voltage load break connector 10 of the present invention is shown installed on transformer tank 9 in which transformer 8 is located. Connector 10 generally includes bushing 14 and elbow 12 which is integrally connectable over bushing 14. Elbow 12 includes an insulated conductor receiving portion 16 which receives high voltage conductor 26 therein, and a right-angled probe retainer portion 18. The exterior conductive surface of the elbow 12 is interconnected to ground 6 through ground strap 4 interconnected to a grounding aperture, or hole, 54 in grounding tab 52 (best shown on FIG. 2). This ensures that the outer surface of elbow 12 remains at ground potential. Bushing 14 is installed through a hole, or aperture 7 in enclosure wall 9 of transformer 8 and is electrically connected to a transformer winding (not shown). Bushing 14 includes an internal shank end 20 and a probe receiving portion 22 forming opposite ends of bushing 14 separated by flange 72. Probe receiving portion 22 of bushing 14 is received within probe retainer portion 18 of elbow 12 upon interconnection thereof.

Figure 2:
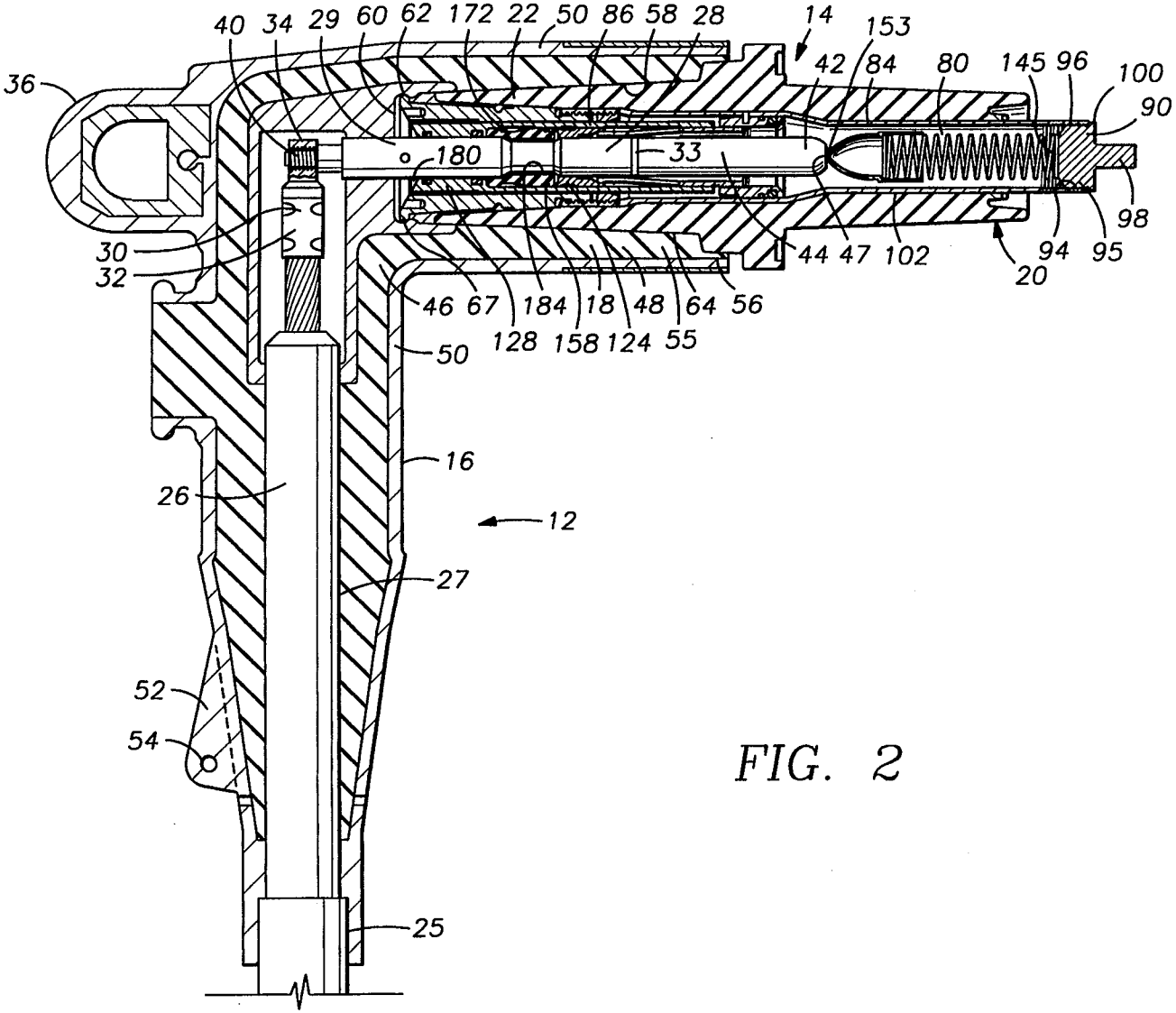
FIG. 2 is a sectional view of the connector of FIG. 1 at Section 2—2, showing the interconnection of the elbow and bushing components.

Referring now to FIG. 2, elbow 12 is a generally right-angled member having conductor receiving portion 16 in which an insulated conductor 26 is received, probe retainer portion 18 disposed at a right angie thereto, and conducting probe 28 disposed within and extending outward from retainer portion 18. As described more fully below, the conducting portion of probe 28 engages the current-carrying components of bushing 14 when elbow 12 is installed on bushing 14 and thereby completes the electrical path between insulated conductor 26 and bushing 14, and thus the transformer winding. Insulated conductor 26 is a load-carrying conductor which typically conducts current of one phase of a three-phase distribution network. Conductor 26 terminates within elbow 12 in a bi-metallic friction welded, compression connector 30 designed to accept copper or aluminum conductors. Connector 30 includes an aluminum crimping portion 32 which is crimped to the end of the conductor 26 disposed within conductor receiving portion 16, and a copper threaded stud retainer 34 projecting from the crimping portion 32. Conductor 26 is enclosed in a layer of insulation 27 which terminates inward elbow 12, which is further enclosed in a semi-conducting layer. This semi-conducting layer may be comprised of several different rubber or plastic materials, including EPDM rubber. Conductor receiving portion 16 further includes a pulling eye 36 protruding from the rear portion thereof, ground tab 52 having hole 54 therein, and, optionally, a test port 38 for receiving a fault detector or other circuit testing device. (Shown in FIG. 8). The test port 38 provides a mechanism to determining if the circuit is energized and for mounting a fault detector to the circuit.

Figure 4:
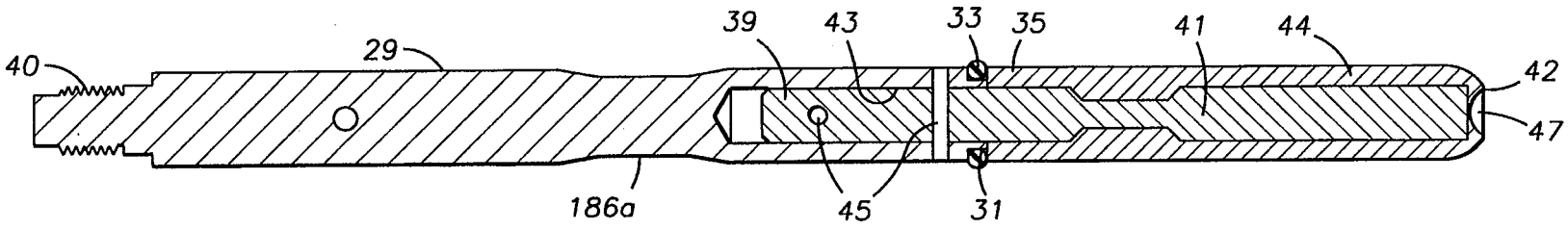
FIG. 4 is an enlarged sectional side view of the probe of the elbow shown in FIG. 2 at 4—4.

Referring now to FIGS. 2 and 4, probe 28 is an elongated conducting member having a first threaded end 40 and a second arc follower end 42 and generally comprised of tin-plated copper shank portion 29, arc follower 44 and interconnecting insert 41 which are integrally interconnected. Arc follower end 42 forms the distal end of arc follower 44 and includes an inward projecting dimple 47 therein. Threaded end 40 is formed on one end of shank portion 29 for threadingly engaging into stud retainer 34 at the interface of conductor receiving portion 16 and probe retainer portion 18 of elbow 12. The opposite end of shank portion 29 includes a central bore 43 for receiving insert 41 as described below. Arc follower 44 is a tubular member and is preferably formulated from a molded ablative material such as a combination of 62½% Celcon Grade GP M90-04, available from Celanese Plastic Company of Chatham, N.J. and 37½% Melamine Aero available from American Cyanamid Industrial Aluminum & Plastic Division of Wayne, N.J., plus or minus 3%, combined to form 100% of the material. This formulation of material is molded into a tubular configuration over a segment of insert 41 which is preferably fabricated of an insulative glass reinforced epoxy compound. The segment 39 of insert 41 that is not molded within arc follower 44 extends outward from the molded portion and is retained in central bore 43 in the end of shank 29 by a pair of pins 45 which are inserted through shank 29 and insert segment 39 at a ninety degree relationship to one another. The outer diameter of shank 29 terminates in a recess 31, which receives an are resistant metal ring 33 therein. The engagement of insert 41 into shank 29 brings the inner end 35 of arc follower 44 into contact with ring 33, to form a continuous surface on the outer periphery of probe 28. The outer diameter of ring 33 is sized to be received in recess 31 flush with the outer surfaces of shank portion 29 and are follower 44.

Figure 8:
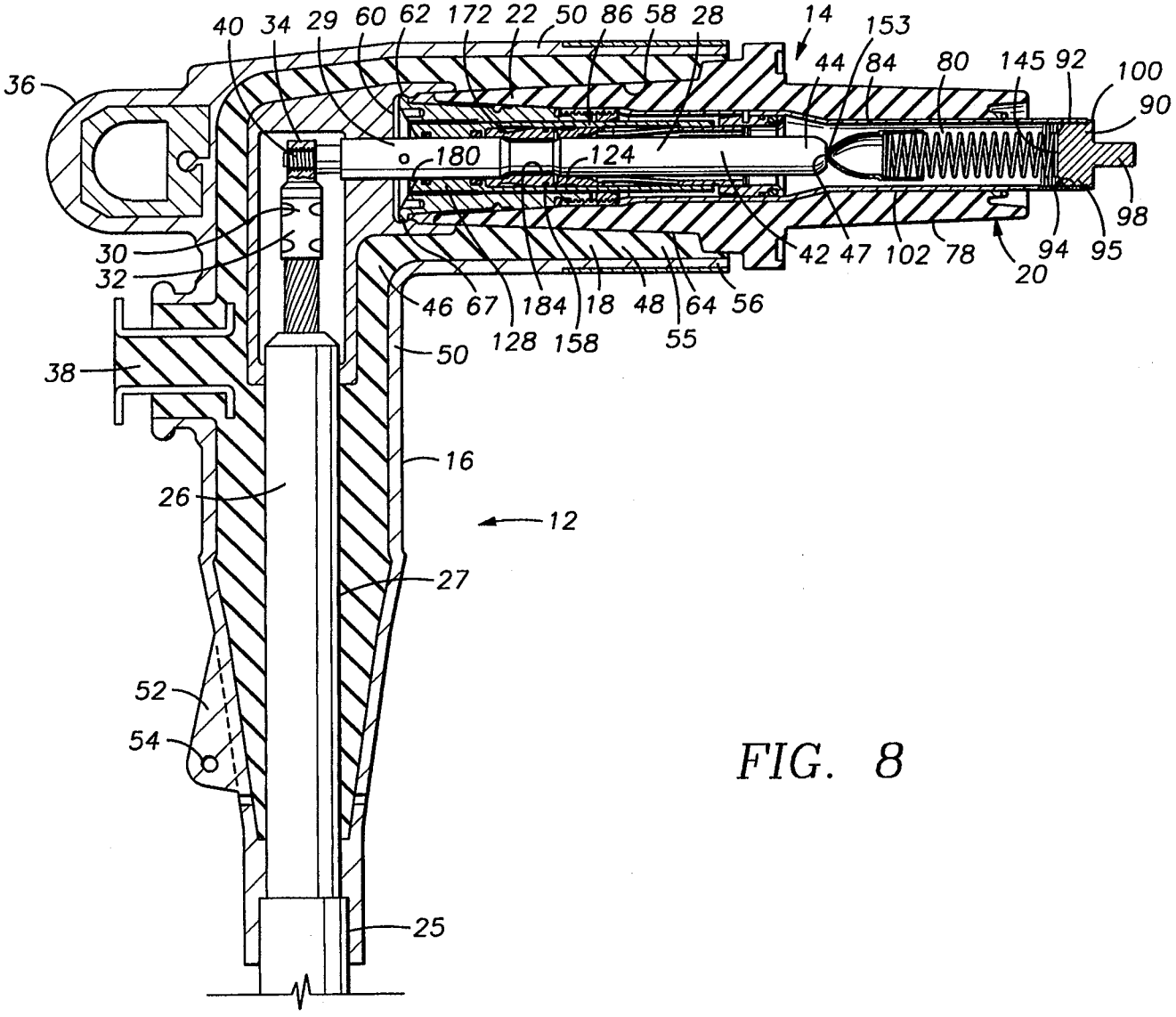
FIG. 8 is a partial, sectional view of the elbow connector of FIG. 1 showing the test port.

Referring again to FIG. 2, to help maintain probe 28 and conductor 26 in a right angled configuration within elbow 12, conductor 26 and probe 28 are interconnected within a semi-conductive body 46. Body 46 is preferably constructed from a semi-conducting EPDM rubber, which helps control electrical stress at the interface of probe 28 and conductor 26 at connector 30. Body 46 is then further molded within an insulative shroud 48. Shroud 48 is preferably manufactured from insulative EPDM rubber. Shroud 48 is then further covered with a semi-conducting shield 50, which is preferably manufactured by molding a semi-conducting EPDM layer over shroud 48 and is approximately 0.1 inches thick. Shroud 48 and shield 50 comprise the structure of insulated conductor receiving portion 16 and probe retainer portion 18, and cooperate to retain semi-conducting body 46 within elbow 12. Grounding tab 52, with a conductor hole 54 therein, is disposed on shield 50 at the base of insulated conductor receiving portion 16 for grounding elbow 12 with ground strap 4 to ground rod 6 or other grounding mechanism as shown in FIG. 1. Alternatively, as shown in FIG. 8, an electrode may be is included in test port 36, and is capacitively coupled to the semi-conductive insert 46, and therefore, cable 26.

Referring still to FIG. 2, probe retainer portion 18 is configured to protect probe 28 and to slidingly engage receiving portion 22 of bushing 14 when probe 28 is inserted into bushing 14. Retainer portion 18 generally includes an annular segment 55 defined by an outer circumferential wall 56 formed by shield 50, an inner frustoconical wall 58 and probe wall 60 on conductive body 46. Frustoconical wall 58 terminates within receiving portion 18 at probe wall 60. An undercut retaining recess 62 is formed at the interface of probe wall 60 and frustoconical wall 58. Retaining recess 62 comprises a rounded cutout projecting radially outward at the interface of walls 58 and 60. The frustoconical wall 58 and probe wall 60 comprise the boundaries of a probe annulus 64 which is in the form of a truncated cone. Probe 28 is disposed substantially co-axially to, and within, probe annulus 64. Retainer portion 18 is sized such that the shank portion 29 of probe 28 terminates within annulus 64 while arc follower portion 44 extends outside of annulus 64.

Figure 3:
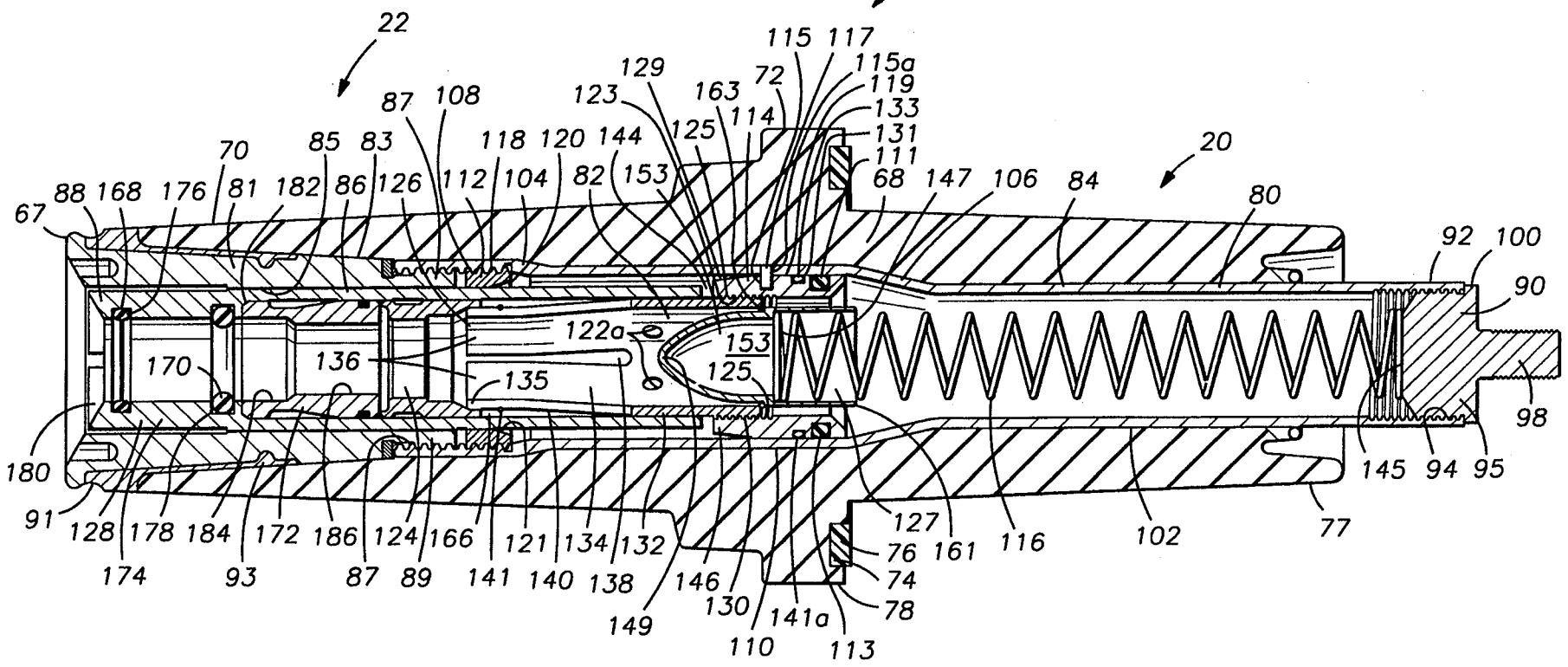
FIG. 3 is an enlarged sectional view of the bushing components of the connector shown in FIG. 2.
Figure 6:
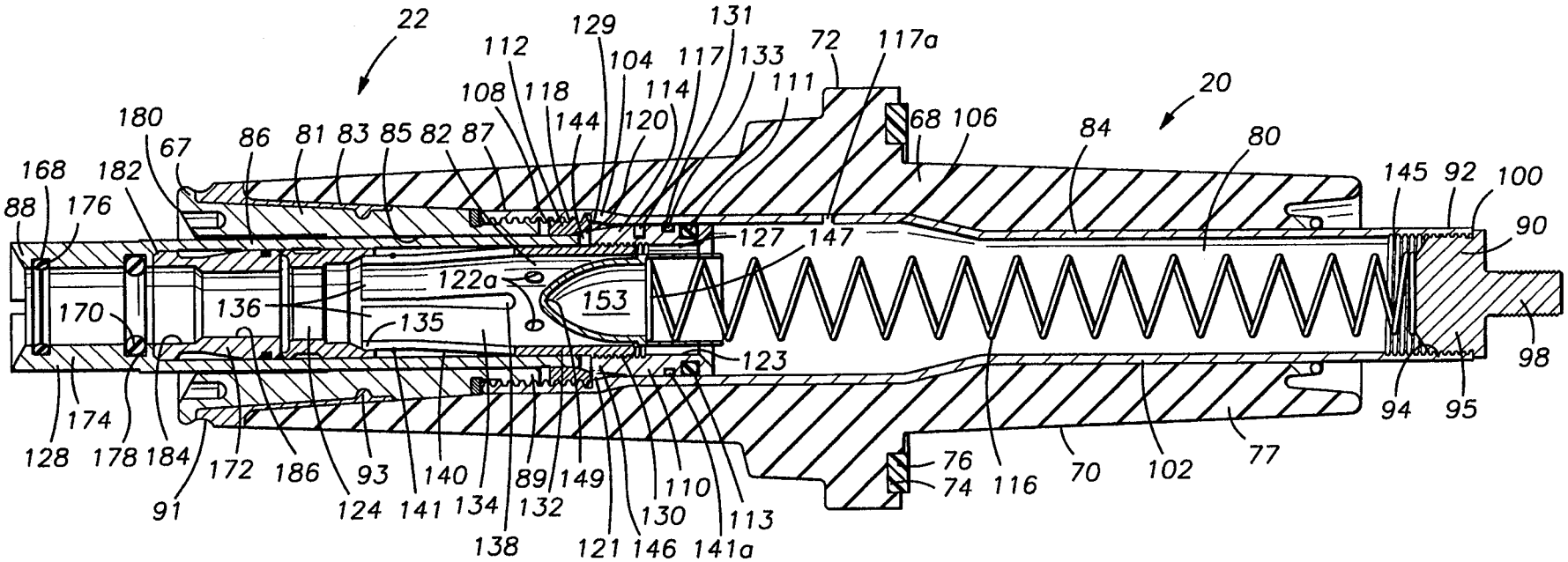
FIG. 6 is the sectional view of the bushing components of the connector of FIG. 2, showing the tulip contact moved to the second position in response to a fault connection; and, FIG. 7 is an enlarged view of the bushing components of the connector of FIG. 2.
Figure 7:
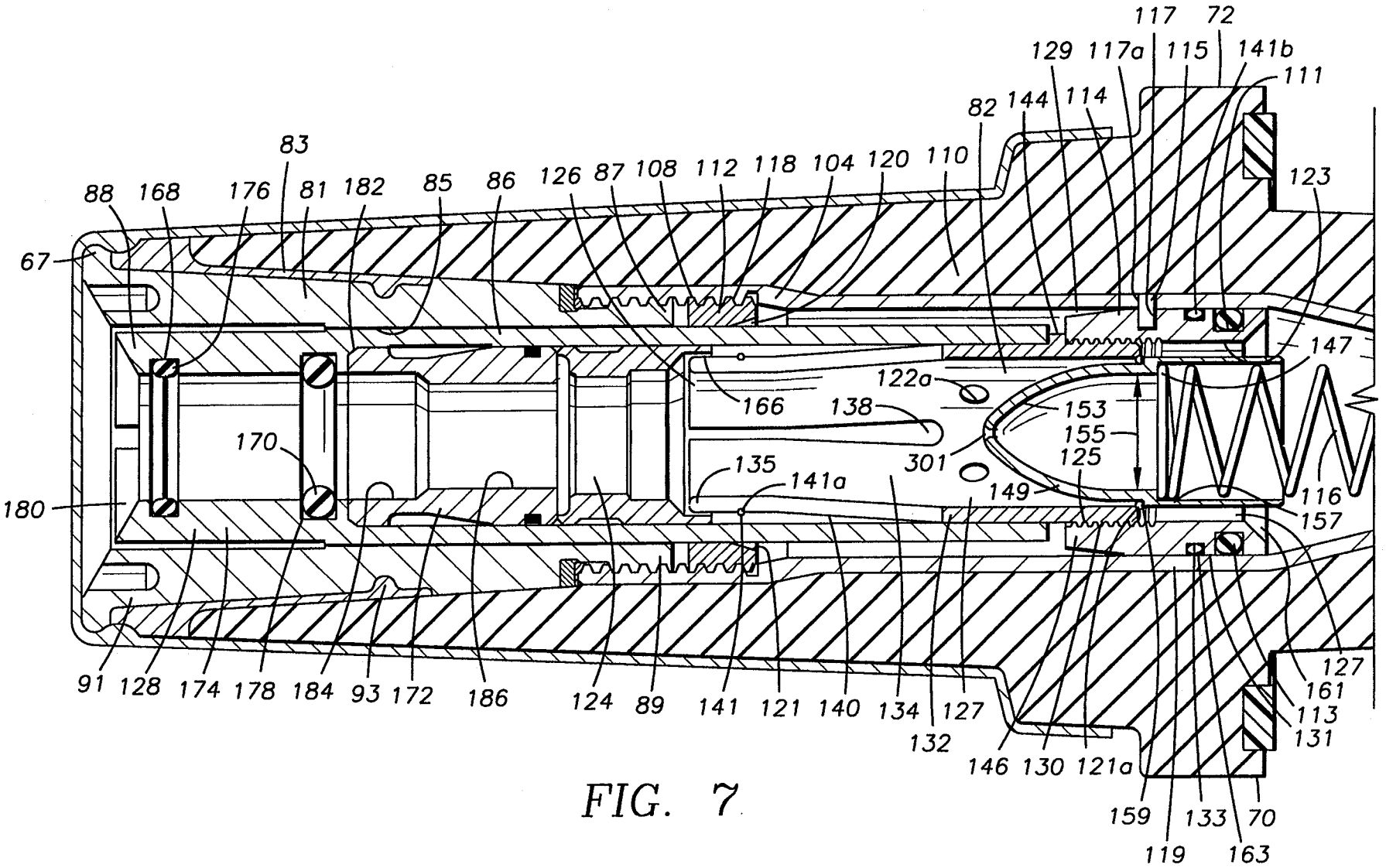

The details of bushing 14 are best shown in FIGS. 3, 6 and 7. Referring first to FIG. 3, bushing 14 is a generally longitudinal member comprising annular bushing body 68 and bushing component subassembly 82 received therein. Bushing body 68 forms internal shank end 20 and probe receiving portion 22 and includes a raised transformer flange 72 which separates shank end 20 from receiving portion 22. Body 68 is preferably made of an epoxy, such as a silica filled novalac molding compound. The outer periphery of bushing transformer flange 72 is covered with a thin coating of conductive paint 70. Internal shank end 20 includes an outer surface 77 which is configured to be received within transformer enclosure 9. (Shown in FIG. 1). Transformer flange 72 is configured to limit the travel of bushing body 68 inward transformer tank 9 as internal shank end 20 is installed into the transformer tank 9. Flange 72 includes a groove 74 and gasket 76 disposed in groove 74, to seal bushing 14 against enclosure wall 9 of transformer 8. (Shown in FIG. 1).

Bushing body 68 further defines bushing annulus 80 which is an annular bore extending the length of bushing 14 in which the bushing component subassembly 82 is received. Bushing annulus 80 is configured to have a generally cylindrical profile through internal shank end 20. The diameter of annulus 80 increases within probe receiving portion 22. Thus, bushing body 68 is thicker in internal shank end 20 than in probe receiving portion 22. Probe receiving portion 22 further includes nose piece 81 therein, which terminates in an outer raised lip 67, which is configured to be received within retaining recess 62 of elbow 12. (shown in FIG. 2). Nose piece 81 is a separable molded nylon member, which is received within receiving portion 22 and includes an outer frustoconical portion 83 conformed to be matingly received against the inner tapered portion of bushing annulus 80, and an inner, generally right cylindrical inner aperture 85 therethrough. The inner end 87 of nose piece 81 includes an outer threaded annulus 89, the smooth interior diameter of which is a continuation of aperture 85. Raised outer lip 67 is disposed on an extending portion 91 of nose piece 81 disposed thereon opposite threaded annulus 89. A semi-conducting nylon shroud 93, extends partially inward raised lip 67 and forms an interdisposed membrane between nose piece 81 and the inner surface of receiving portion 22 over a portion thereof.

Bushing component subassembly 82 is disposed within annulus 80 and nose piece 81 and generally includes an elongated tubular housing 84, contact tube 86, closure 90, and piston 114.

Tubular housing 84 is a thin tubular conducting member, preferably constructed of copper, disposed within bushing annulus 80 and extending from outward the end of internal shank end 20 approximately midway through probe receiving portion 22 where it engages nose piece 81 at threaded annulus 89. Housing 84 includes a first cylindrical portion 102 disposed within internal shank end 20 and terminating outside of internal shank end 20 at end 92, a second enlarged portion 104 of increased diameter disposed and terminating within probe receiving portion 22 at nose piece threaded annulus 89, and a tapered blend portion 106 interconnecting first and second portions 102 and 104. Enlarged portion 104 of housing 84 terminates in an internally threaded piston stop bore 108 into which nosepiece 81 and annular piston stop 112 are threadingly assembled. First cylindrical portion 102 includes an internally-threaded segment 94 at end 92 to receive closure 90.

Closure 90 is a conductive element, preferably fabricated from brass which encloses the end 92 of contact tube 86. Closure 90 includes a threaded major diameter portion 95 received within mating threaded segment 94 at the end 92 of housing 84, and a minor diameter threaded stud portion 98 projecting outwardly therefrom. To limit the travel of closure 90 within housing 84, closure 90 is provided with a lip portion 100 which forms an annular ledge disposed between major diameter portion 95 and stud portion 98. Lip portion 100 limits the travel of closure 90 inward housing 84 by bearing upon end 92 when closure 90 is fully seated in interior threaded segment 94. Transformer 8, shown in FIG. 1, is interconnected to stud 98 by a transformer lead, not shown.

Piston assembly 110 includes piston 114 and piston stop 112. Piston 114 is an annular member which is normally rigidly disposed within second enlarged portion 104 of housing 84, but is selectably slidingly actuable from tapered blend portion 106 to piston stop 112 in response to a fault closure as will be described further herein. Piston stop 112 includes an outer threaded surface 118 which is threadingly engaged in piston stop bore 108, a central bore 120 through which contact tube 86 is slidingly received, and a chamfered frustoconical bearing face 121 which is disposed inward housing 84. During a high current fault closure of elbow 12 onto bushing 14, while conductor 26 is energized, excessive high-energy arcing occurs. The gas generated due to arcing urges piston 114 towards stop 112. Stop 112 is disposed in housing 84 to limit the outward or forward travel of piston 114.

Referring now to FIGS. 3 and 7, piston 114 is a generally tubular member, preferably manufactured from copper, and includes an inner bore 123, having a first inner threaded portion 125, a second inner gas trap receiver portion 127, and an outer cylindrical portion or wall 119. Wall 119 includes front tapered frustoconical piston face 129 having a profile complementary to bearing face 121 on stop 112, and a rearward projecting cylindrical portion 131. Cylindrical portion 131 includes a circumferential contact groove 111 and a circumferential seal groove 133 therein. A pin recess 117 is disposed adjacent the intersection of piston face 129 and cylindrical portion 131, and includes pin 115 therein. The adjacent portion of elongated tubular housing 84 includes a mating hole **117*a*, which receives a portion of pin 115. The end of gas trap receiver portion 127 includes a circumferential frustoconical pilot 161** thereon.

Piston 114 is normally biased away from stop 112 and held in position by the shear pin 115 which is disposed in recess **117*a* in the outer wall 119 of piston 114. Spring 116 is disposed between the rear of piston 114 and closure 90, and bears upon gas trap 149 which is disposed in gas trap receiver portion 127 in tulip contact 122 as will be further described herein. Spring 116 is held in compression such that a forward force on gas trap 149 is induced to bias the gas trap 149 into piston 114 and contact 122**.

Tapered frustoconical face 129 on piston is tapered approximately 8 degrees from horizontal, and bearing face 121 on piston stop 112 is tapered approximately 15 degrees from horizontal. As a result of this combination of tapers, when piston 114 is extended forward, as it enters stop 112, it will collapse slightly radially inward and the threads on stop 112 will expand and dig into piston stop bore 108, thus preventing stop 112 and piston 114 and components attached thereto from being expelled out the bushing.

Tulip contact 122 is an elongated tubular member preferably comprised of copper or brass and generally shaped like the flower of a tulip plant, having a threaded base 130 including a gas trap dome receiver portion 127*a*, an extension portion 132 and a tapered petal portion 134. Tapered petal portion 134 is composed of a series of circumferentially disposed petals 136 extending from extension portion 132 to petal end 135 and having longitudinal slots 138 therebetween. From the interface with extension portion 132, each petal 136 is slightly bent radially inward, forming a clearance annulus 140 between petals 136 and the interior surface of contact tube 86. Slots 138, and the space of clearance annulus 140, permit petals 136 to actuate radially outward upon insertion of probe 28 therein. To increase the radial force imparted by petals 136 on probe 28, a snap ring 141 is disposed about the outer periphery of petals 136 positioned in a groove 141*a* near petal end 135.

To interconnect tulip contact 122 and piston 114 so as to provide for concurrent reciprocal movement thereof within bushing 14 in response to fault interconnection, first threaded portion 125 of piston 114 receives threaded base 130 of tulip contact 122. To limit the extension of threaded base 130 into first threaded portion 125, tulip contact 122 includes flange 144 which forms the terminus of the threaded base 130 and which bears upon the end 146 adjacent frustoconical face 129 of piston 114. The tulip contact 122 includes an end portion 137 received in piston 114, and includes a frustoconical face 121*a* thereon. Piston 114 and tulip contact 122 are maintained in electrical contact with tubular housing 84 by means of contact spring 113 which is disposed about piston 114 within groove 111 in the outer circumferential portion thereof, and forms the preferred current path through the bushing 14. Contact spring 113 is preferably a silver-plated beryllium copper-wound spring contact. A seal 141*b* is disposed about piston 114 within groove 133 to seal the annular space between piston 114 and contact tube 86.

Referring generally to FIGS. 3, 6 and 7, but particularly to FIG. 7, first end 145 of spring 116 is seated on closure 90, and second end 147 is received within gas trap 149. Gas trap 149 is a generally cylindrical member having a projecting conical end portion formed of annulus 151 terminating in a dome 153. The minor diameter 155 of dome 153 is slightly smaller than the diameter of annulus 151, and an inner step, or ledge 157 and outer an step, or ledge 159, are therefore formed at the intersection thereof. End 147 of spring 116 bears against inner step 157, and a seal ring 163 is disposed on outer step 159 and received in a groove 159*a* therein. Dome 153 projects into piston 114 and is received in gas trap dome receiver portion 127*a* of tulip contact 122, and seal 163 is disposed between outer step 159 and frustoconical face 121*a* (Best shown in FIG. 7).

Referring now to FIGS. 3, 6 and 7, contact tube 86 retains the components which engage probe 28 of elbow 12, including tulip contact 122 which is threadingly engaged in piston 114, an ablative insert 124 disposed generally adjacent the petal ends 135 of tulip contact 122, and an outer seal portion 128 disposed adjacent end 88 of contact tube 86. Contact tube 86 is placed over the outer portion of tulip contact 122 and bears upon flange 144 opposite piston 114. Contact tube 86 interferingly engages the outer surface of extension portion 132 of tulip contact 122 to ensure movement of tube 86 concurrent with movement of piston 114. Four rivets 122*a*, two of which are shown, are spaced circumferentially through tube 86 and tulip contact 122 to insure connection between contact tube 86 and the tulip contact 122/piston 114 combination. Contact tube 86 is preferably manufactured from filawound glass and epoxy.

Figure 5:
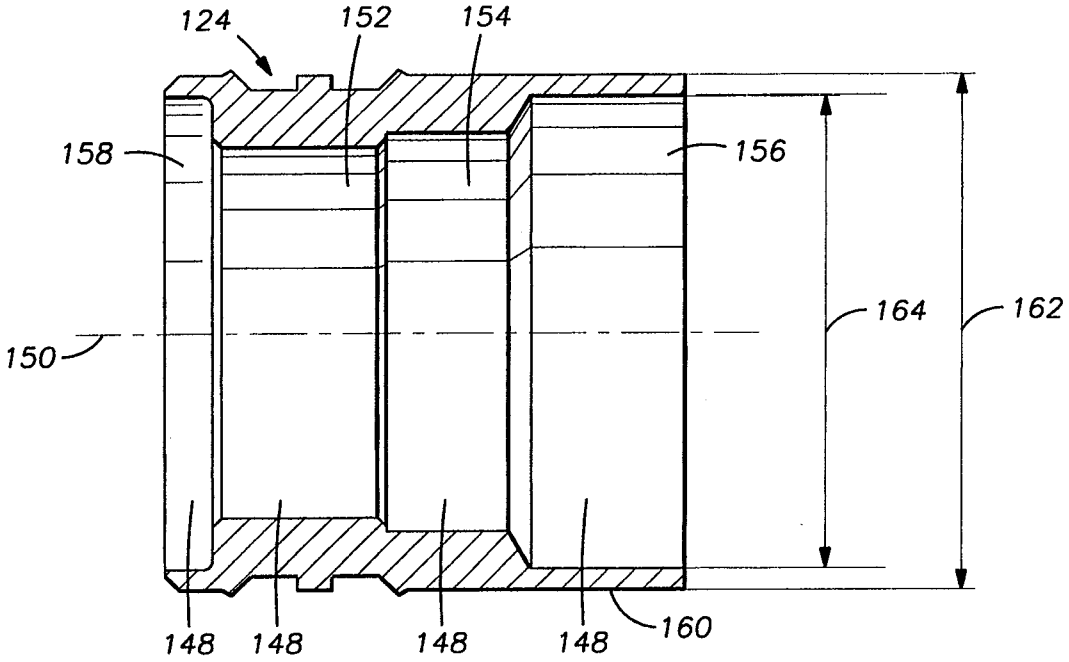
FIG. 5 is an enlarged sectional view of the ablative insert of the bushing shown in FIG. 3.

Referring now to FIGS. 3 and 5, the construction of ablative insert 124 and its interaction with tulip contact 122 is shown. Ablative insert 124 is a generally tubular member having a series of concentric bores 148 disposed concentrically about a central longitudinal axis 150 to form an annular member. Ablative insert 124 is preferably molded from an injection moldable ablative material which, when in contact with an electrical arc, will form an arc quenching gas to help extinguish the arc. The material currently found preferable for ablative insert 124 is a molded ablative material formed of a combination of 50% Celcon Grade GP M90-04, available from Celanese Plastic Company of Chatham, N.J., 50% (plus or minus 3%) Melamine Aero available from American Cyanamid Industrial Aluminum & Plastic Division of Wayne, N.J., and one quarter percent cadmium red designated VX 8825 and available from Ferro Corporation, Color Division I, Erieview Plaza, Cleveland, Ohio, combined to comprise 100% of the material. This material is molded into the configuration of insert 124. Bores 148 include an alignment bore 152 for receiving and aligning probe 28 as it passes therethrough upon placement of elbow 12 over bushing 14, a relief bore 154 immediately adjacent alignment bore 152, an extension bore 156 into which tulip contact petal ends 135 project, and a seal extrusion bore 158 disposed opposite extension bore 156. Extension bore 156 forms the inner pilot to receive tulip contact petal ends 135, and is bounded by an annular extension projection 160 which projects into clearance annulus 140 between petals 136 and contact tube 86. The outer diameter 162 of annular extension projection 160 is slightly less than the inner diameter of contact tube 86, and the inner diameter 164 of extension projection 160 is sized to permit tulip contact 122 to expand outward into a secondary clearance annulus 166, which annulus is formed by the annular space between the outer surface of tulip contact 122 and inner diameter 164 (Shown in FIG. 7). Annular extension projection 160 extends approximately one-quarter inch within clearance annulus 140 from tulip terminal end 135, but may be varied depending upon the size and clearances of the bushing components. The extension of projection 160 within annulus 140 is limited by the presence of snap ring 141. It should be appreciated that in certain situations, tulip contact 122 may not need the secondary force supplied by snap ring 141, and in such circumstances projection 160 may project further within clearance annulus 140. The extent to which projection 160 extends within clearance annulus 140 from petal ends 135 is limited solely be the clearance required to permit petals 136 to actuate radially outward to receive probe 28 and the linear distance to the extension portion 132 of the tulip contact 122.

Referring again to FIGS. 2, 3, 5 and 7, outer seal portion 128 of contact tube 86 is disposed adjacent contact tube outer end 88 and includes packing ring 168, o-ring seal 170 and elastomeric insert seal 172. Contact tube 86 includes a thickened wall 174 adjacent end 88. A pair of grooves 176 and 178 are disposed within wall 174. First groove 176 is disposed adjacent the open end 88 of contact tube 86, and second groove 178 is disposed further inward contact tube 86 from first groove 176. Packing ring 168 is disposed in first groove 178, and o-ring 170 is disposed in second groove 178. The inward terminus of thickened wall 174 terminates in a blended ledge which forms an annular stop 182. Insert seal 172 is received in tube 86 and bears against stop 182 on one end and against ablative insert 124 at the other end. Insert seal 172 includes a first enlarged pilot bore 184 therein disposed adjacent o-ring 170, and a reduced diameter sealing bore 186 concentric with bore 184 and disposed adjacent insert 124.

Referring now FIG. 2, the interconnection of the bushing 14 and elbow 12 is shown. Prior to interconnection of bushing 14 and elbow 12, probe 28 is disposed adjacent open end 88 of contact tube 86 and aligned for engagement therein. Then, pressure is exerted on the back of elbow 12 against pulling eye 36 such that arc follower 44 enters into outer seal portion 128. Further force on pulling eye causes further inward movement of arc follower 44 and probe 28 through elastomeric insert seal 172, until arc follower 44 is disposed within ablative insert 124 and probe retainer portion 18 of elbow 12 is disposed adjacent and over probe receiving portion 22 of bushing 14, eventually causing raised lip 67 to be captured within recess 62, thereby securing elbow 12 to bushing 14. Seal extrusion bore 158 of ablative insert 124 allows a portion of insert seal 172 to extrude into extrusion bore as probe 28 is inserted therethrough. Further, in the absence of extrusion bore 158, elastomeric insert seal 172 can interfere with insertion of probe 28 into contact 122.

Sealing bore 186 is sized to provide a tight seal with arc follower 44 and probe body 29, which prevents the release of gasses generated by arcing between contact 122 and probe 29 when elbow 12 is connected to or disconnected from bushing 14. The extrusion bore 158 of ablative insert 124 and annular clearance space 300 are provided to allow sealing bore 186 to expand to allow insertion of the larger arc follower 44 and probe 29.

When elbow 12 is fully engaged on bushing 14, the sealing bore 186 aligns with the undercut section **186*a* of probe 29. Undercut 186*a* is provided to prevent the sealing bore 186 of the elastomeric insert seal 172 from taking a permanent set at a larger diameter, thus reducing the sealing capabilities of bore 186. Any untimely leakage of hot arcing gasses during switching operations could result in flashover to ground. The seal between probe receiving portion 22 of bushing 14 and probe retainer portion 18 of elbow 12 provides a water tight seal, preventing egress of contaminants into Bushing 14**.

Referring now to FIGS. 2 and 3, during this installation process, as probe shank portion 29 approaches the end 135 of tulip contact 122, or during live loadbreaks, when the live conductor 26 and elbow 18 are pulled off of bushing 20, an arc may form between the tulip contact 122 and the probe shank portion 29. This arc may be conducted directly through the air between tulip contact 122 and probe shank 29 along the surface of arc follower 44. The arc may also be conducted from probe shank 29, along the inner bore portion 148 of ablative insert 124 and along the surface of arc follower 44 to tulip contact end 135. As elbow 12 is seated over bushing 14, further inward pressure on pulling eye 36 causes further travel of probe 28 and are follower 44 within tulip contact 122, and petal portions 134 actuate radially outward to accept and grip probe shank 29. Arc follower 44 is disposed within piston 114 upon total insertion of elbow 12 over bushing 14 and dimple 47 engages dome 153, thereby actuating seal ring 163 off of frustoconical face **121*a*. As probe 28 is passed through insert seal 172 of outer seal portion 128, pilot bore 184 aligns probe 28 for further insertion into bushing 14, and then sealing bore 186 engages the outer surface of probe 28 and is slightly distorted into seal extrusion bore 158 of insert 124. As an are forms, it generates gasses which increase the pressure within housing 84. Once elbow 12 is fully inserted over bushing 14 and probe 28 is received in tulip contact 122, an electrical path is established from conductor 26 through connector 30, probe shank portion 29, tulip contact 122, piston 114, spring 113, housing 84 and closure 90. Because closure 90 is electrically interconnected to the transformer 8, the electric path from conductor 26 to transformer 8** is thus established.

Referring now to FIG. 6, if a fault condition exists during insertion of elbow 14 over bushing 12, the pressure created by gasses generated during arcing will build to a level sufficient to cause gas pressure between piston 114 and closure 90 to build to a level sufficient to shear pin 115 and cause piston 114, tulip contact 122 and contact tube 86 to move forward as a result of the gas pressure toward bushing open end 180. Such travel is limited by the engagement of piston bearing face 129 on piston stop 112 surface 121. When a fault connection is made, the forward motion of piston 114 and contact tube assembly 86 results in an electrical connection between probe shank 29 and tulip contact 122 and extinguishing the arc. This connection occurs very quickly due to the arcing gas assist resulting in reducing the time duration of the arc to a minimum. Contact tube 86 will extend out the end of bushing 12. As a result, elbow 12 will not attach to bushing 14, providing an obvious visual indication of a fault on the line to the installer. Once pin 115 has sheared, the bushing 14 must be replaced.

During a load break operation, gas trap 149 will actuate forward out of tubular housing 84 to seal against the frustoconical face 121 on tulip contact 122. Significant pressure is trapped behind gas trap 149 after a loadbreak operation, which can be substantial enough to make it very difficult to push the probe 29, and elbow 12, back over the bushing. A small vent hole 301 (Shown in FIG. 7) is provided in dome 153 of gas trap 149, and is sized to allow a controlled slow release of pressure from behind gas trap 149. Once the arc generated gas pressure equalizes on both sides of the gas trap 149, the spring 116 will cause gas trap 149 to remain positioned against the frustoconical face **121*a* of tulip contact 122**.

During insertion of probe 28 into tulip contact 122, or pulling therefrom, the presence of the arc on the ablative insert 124 will cause the portion of the surface of the insert 124 in contact with the arc to ablate, which releases an arc quenching vapor or gas. The presence of extension 160 on ablative insert 124 blocks access of the arc to the inner surface of contact tube 86 within clearance annulus 140 because it is disposed between tulip contact petals 134 and contact tube 86 in clearance annulus 140. Likewise, if an arc is able to roll over into the clearance annulus 140, it will cause the ablative projection 160 to ablate and thereby produce an arc quenching gas to help extinguish the arc, as well as preventing the arc from making contact with inner surface of contact tube 86. If the arc reaches the surface of contact tube, carbonization can occur, and deposits of carbon may be released from the contact tube and onto the surfaces of probe assembly 28, ablative insert 124 and seal 172, causing an increase in arcing time and the damage associated with sustained arcing.

Thus, the present invention provides an improved separable connector 10 having improved arc snuffing capabilities. By reducing the arcing which may occur during elbow 12 to bushing 14 interconnection and disconnection, the amount of arc-generated back pressure which interferes with the interconnection of the elements, is reduced. Further, the incidence of carbonization and burning of components is reduced, which results in a connector 10 having switching characteristics with greater reliability and durability.

I claim:

1. A bushing for a high voltage connector, comprising;

a housing;

a substantially non-conducting tubular contact tube disposed within said housing and having an interior surface;

a contact disposed in said contact tube and having at least one radially outwardly actuable contact finger, said finger being disposed radially inward from said interior surface of said contact tube;

an arc sensitive insert portion disposed adjacent said contact finger and disposed between said contact and said contact tube.

2. The bushing of claim 1, further including an ablative insert disposed adjacent said contact.

3. The bushing of claim 1, wherein said contact tube includes a first open end and an ablative insert is disposed in said tube between said open end and said contact.

4. The bushing of claim 3, wherein said arc sensitive portion is an integral extension of said ablative insert.

5. The bushing of claim 1, wherein said arc sensitive portion is disposed to physically block access of any arc from the surface of contact tube.

6. The bushing of claim 1, wherein said arc sensitive insert is constructed of an ablative material.

7. The bushing of claim 1, wherein said contact is a tulip contact.

8. A high voltage connection, comprising:

an elbow connector having a probe therein;

a bushing having a bore therein for receiving said probe;

a contact disposed in said bore, said contact being sized to engage said probe upon insertion of said probe into said bore, said contact including an actuable portion which moves upon engagement of said probe therewith;

said bore having a size sufficiently greater than the size of said contact to permit free movement of said actuable portion, said bore and said actuable portion defining a gap therebetween;

an arc-sensitive insert disposed in said gap.

9. The connection of claim 8, wherein said insert is constructed of an ablative material.

10. The connection of claim 9, wherein said bore further includes an annular ablative ring disposed adjacent said contact and said insert is an extension thereof.

* * * * *